US006170180B1

(12) United States Patent
Schaeff

(10) Patent No.: US 6,170,180 B1
(45) Date of Patent: Jan. 9, 2001

(54) EXCAVATOR, IN PARTICULAR A MINI-EXCAVATOR

(75) Inventor: Hans Schaeff, Langenberg (DE)

(73) Assignee: Karl Schaeff GmbH & Co., Maschinenfabrik, Lagenburg (DE)

( * ) Notice: Under 35 U.S.C. 154(b), the term of this patent shall be extended for 0 days.

(21) Appl. No.: 09/266,865

(22) Filed: Mar. 12, 1999

(30) Foreign Application Priority Data

Mar. 18, 1998 (DE) ..... 298 04 856

(51) Int. Cl.[7] ..... E02F 3/00

(52) U.S. Cl. ..... 37/443; 37/466; 37/410; 220/562; 220/4.14

(58) Field of Search ..... 37/443, 466, 410; 172/431, 432, 435, 436; 220/562, 564, 581, 4.14, 86.1, 86.2; 180/6.58, 6.6, 6.48

(56) References Cited

U.S. PATENT DOCUMENTS

| | | | | |
|---|---|---|---|---|
| 1,521,255 | * | 12/1924 | Scheu | 220/564 X |
| 2,092,392 | * | 9/1937 | Hewitt | 220/564 |
| 3,847,241 | * | 11/1974 | Cameron et al. | 220/564 X |
| 4,629,087 | * | 12/1986 | Lenz | 220/4.14 X |
| 4,771,855 | * | 9/1988 | Takashima et al. | 180/326 |
| 5,711,095 | | 1/1998 | Oda et al. . | |
| 5,715,615 | * | 2/1998 | Murakami et al. | 37/379 |
| 5,794,805 | * | 8/1998 | Branham | 220/86.2 |
| 6,009,643 | * | 1/2000 | Maeba et al. | 37/443 |

FOREIGN PATENT DOCUMENTS

| | | | | |
|---|---|---|---|---|
| 3741399 | | 12/1987 | (DE) . | |
| 0806525 | | 11/1997 | (EP) . | |
| 0816575 | | 1/1998 | (EP) . | |
| 524825 | * | 8/1940 | (GB) | 220/562 |
| 2166093 | | 4/1986 | (GB) . | |
| 2217377 | * | 10/1989 | (GB) | 220/564 |
| 294971 | * | 4/1932 | (IT) | 220/562 |
| WO 97/48917 | | 12/1997 | (WO) . | |

OTHER PUBLICATIONS

Patents Abstract of Japan; Pub.No. 60059239; May 4, 1985; Komatsu Seisakusho KK; vol. 009, No. 194, Aug. 10, 1985.
Patents Abstract of Japan; Pub.No. 08013543; Jan. 16, 1996; Hidehiko and Kazuya; Appln. No. 06140540, Jun. 22, 1994.
Patents Abstract of Japan; Pub.No. 08151660; Jun. 11, 1996; Takashi and Kazuya; Appln. No. 06296488, Nov. 30, 1994.
Patents Abstract of Japan; Pub. No. 09003972; Jan. 07, 1997; Matsui Seiji; Appln. No. 07158198, Jun. 23, 1995.
Patents Abstract of Japan; Pub. No. 09235752; Sep. 9, 1997; Kjimoto Takeshi; Appln. No. 08046316, Mar. 4, 1996.
Patents Abstract of Japan; Pub. No. 09268598; Oct. 14, 1997 Hara Keiichi; Appln. No. 08079767, Apr. 2, 1996.

* cited by examiner

*Primary Examiner*—Victor Batson
(74) *Attorney, Agent, or Firm*—Schlesinger, Arkwright & Garvey LLP

(57) ABSTRACT

An excavator comprises a substructure and a superstructure pivoted on the substructure with an engine compartment and a valve box of the excavator being formed in the superstructure; and at least one fluid tank disposed between the engine compartment and the valve box essentially extending over the width of the superstructure. An excavator includes a first and a second fluid tank abutting each other with one positive and complementary side wall each to provide a particularly simple installation of the tanks in a wedge-like manner while utilizing the room in an optimum manner, for example, in the frame of the superstructure.

10 Claims, 3 Drawing Sheets

EXCAVATOR, IN PARTICULAR A MINI-EXCAVATOR

FIELD OF THE INVENTION

The present invention relates to an excavator, in particular to a mini-excavator.

BACKGROUND OF THE INVENTION

Mini-excavators are generally understood to be micro-excavators which travel on rubber crawler tracks. These machines can drive through door openings of a carcass and are used as so-called construction robots with hydraulic hammers instead of excavator shovels also when renovating buildings.

With such mini-excavators, the aim is undertaken to carry the greatest possible fuel supply despite the very small dimensions. Thanks to this measure, the required refuelling intervals can be kept large. In a similar way, a large supply of hydraulic oil leads to an extension of the oil-change intervals. Furthermore, a large available oil supply improves the oil cooling of the excavator hydraulics.

At the same time, however, an operator's cabin should be made as comfortable as possible for the operator. For example, a driver's seat should be designed with sufficient suspension, which, however, requires a lot of room in the operator's cabin. In the operator's cabin, room is additionally required for a battery, a cabin heater and, for example, for an instrument panel. As the devices named can, in total, often only be fitted with difficulty in an operator's cabin, occasionally open operator's platforms are used, for example with a roll-over bar. To provide an appropriate size to the operator's cabin, the two fluid tanks named above are normally fitted below the driver's seat or in the engine compartment. However, this has the consequence that, for example, when the fuel tank is disposed below the driver's seat, there is no room left for a cabin heater. The disposition of the hydraulic oil tank in the engine compartment, on the other hand, leads to a warming of the oil due to the engine heat so that larger oil coolers are required which, in turn, leads to increased room requirements and/or lowers the engine accessibility.

Another problem which occurs, in particular with mini-excavators, is that due to the strict dimension specifications, the insulation of the engine compartment or of the valve box of the excavator is only possible in an insufficient manner. For the reasons given above, sound-proofing layers of thick construction such as are usual with larger machines cannot be used with mini-excavators.

OBJECTS AND SUMMARY OF THE INVENTION

It is therefore the object of the invention to avoid the disadvantages associated with the disposition of fluid tanks in the engine compartment or in the operator's cabin and at the same time to improve the noise insulation of an excavator, in particular of a mini-excavator.

This object is solved by means of an excavator, in particular a mini-excavator, having the features of the present invention. By the disposing of at least one fluid tank between the engine compartment and the valve box of the excavator, it is effectively possible to dampen or insulate noise which is created in either the engine compartment or the valve box. The at least one fluid tank essentially extending over the width of the superstructure thus performs a dual function, namely the simultaneous noise dampening of the engine compartment and the valve box which are disposed separately from each other. Furthermore, in accordance with the invention, the disposition of a fluid tank within the engine compartment is avoided so that, for example in the event of a hydraulic oil tank, only an oil cooler less complex than the state of the art has to be used. Finally, thanks to the disposition in accordance with the invention of the at least one fluid tank, a larger amount of space is available in the operator's cabin.

In accordance with one preferred embodiment of the excavator in accordance with the invention, an operator's cabin (possessing a driver's seat) of the superstructure of the excavator is essentially formed above the at least one fluid tank. Thanks to the positioning of the operator's cabin above the fluid tank, a particularly effective noise insulation is ensured in the operator's cabin towards engine compartment noise or valve box noise.

Appropriately, the engine compartment, the valve box and the at least one fluid tank are disposed at least partially within a frame of the superstructure. In this way, a particularly compact and robust structure is made available.

Appropriately, a heating device is disposed below the driver's seat of the operator's cabin. In this way, the space made available in the operator's cabin through the disposition in accordance with the invention is utilized in an optimum manner. It is, for example, also easily possible due to the disposition of the fluid tanks in accordance with the invention to provide a driver's seat which has a relatively large construction with a spring frame in the operator's compartment.

In accordance with another embodiment of the present invention, for which separate protection is desired, the excavator possesses a first and a second fluid tank, with these fluid tanks abutting each other with one positive and complementary side wall each. Thanks to such a forming of abutting fluid tanks, a particularly simple installation of the tanks is possible, for example in the frame of the superstructure. The two fluid tanks can thus abut each other in a fixed manner or in a wedge-like manner while utilizing the room in an optimum manner, whereby the noise insulation effect is favorably influenced. By forming the fluid tank with side walls abutting each other obliquely, the tolerance specifications for the fluid tanks are furthermore reduced, whereby a less expensive production is possible.

In accordance with a preferred embodiment of the present invention, the side walls of the fluid tanks, which are inclined in each case, run parallel to the longitudinal direction of the excavator.

Advantageously, the at least one fluid tank is made of metal, in particular of steel, or of plastic. While steel tanks are characterized by a particularly high mechanical stability, the use in particular of plastic tanks leads to a further improvement in the noise dampening or insulation.

One preferred embodiment of the invention will now be described in detail by way of the enclosed drawings.

BRIEF DESCRIPTIONS OF THE DRAWINGS

DETAILED DESCRIPTION OF THE INVENTION

Figure 1:
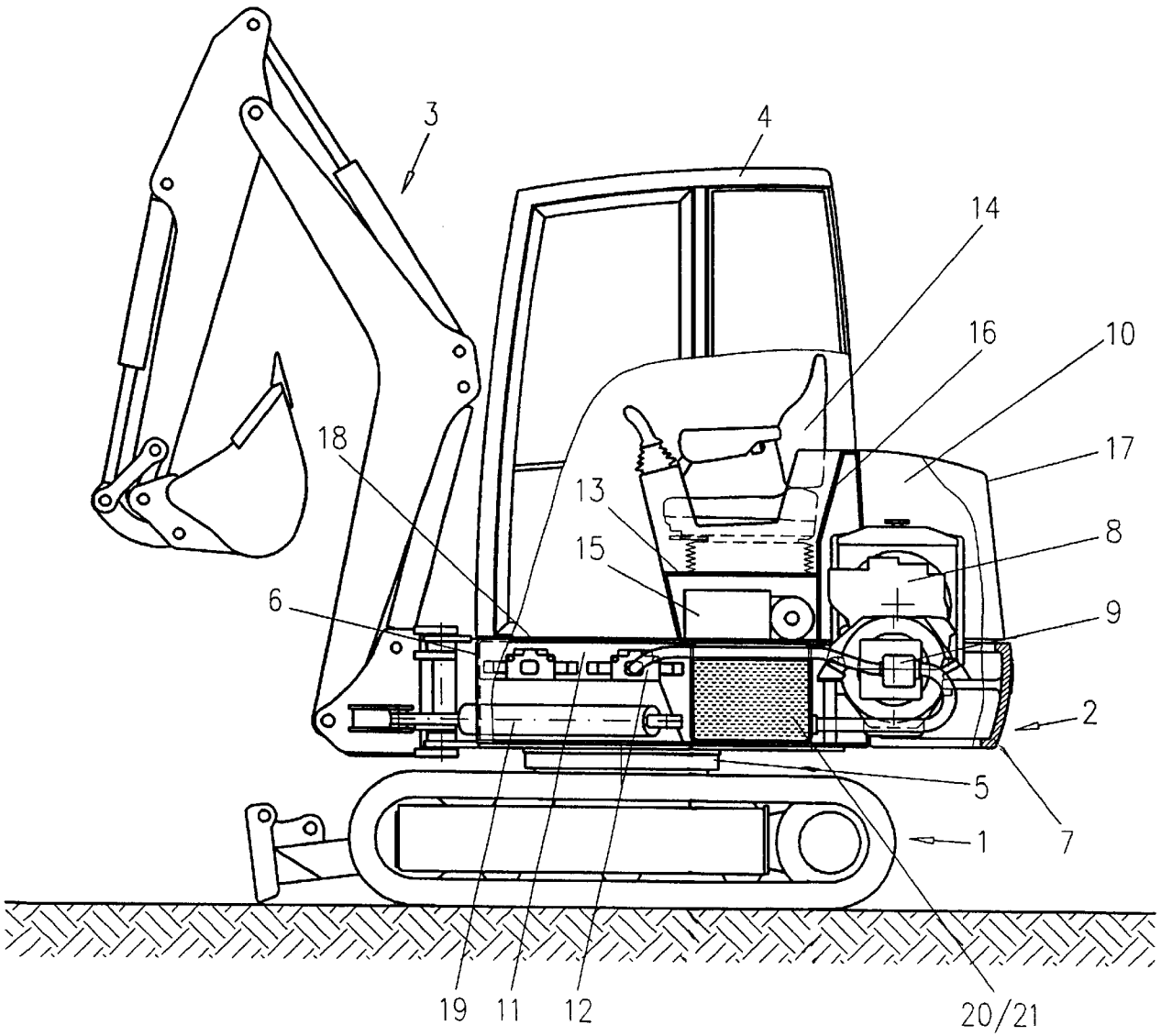
FIG. 1 shows a partially cut diagrammatic side view of a preferred embodiment of a mini-excavator in accordance with the invention.

The mini-excavator shown in FIG. 1 possesses a caterpillar substructure 1 and a superstructure 2. The superstructure 2 is formed with a superstructure frame 6 in which an engine compartment 10 is (partially) disposed and in which a valve box 11 is disposed. An operator's compartment 4 is disposed essentially centrally on the superstructure frame 6. In the operator's compartment 4, a seat console 13 is provided having a driver's seat 14 disposed thereon. Below the driver's seat 14, a heating device 15 is disposed.

Two fluid tanks 20, 21 are disposed between t he engine compartment 10 and the valve box 11. It can be seen from FIG. 2 that the fluid tanks 20, 21 together extend over the total width of the superstructure frame 6. They thus form a partition region between the engine compartment 10 and the valve box 11. The engine compartment 10 is limited to the rear side by an engine bonnet 17 or a tail weight 7.

The engine compartment 10, which normally possesses a high noise and heat development, is separated from the operator's cabin 4 and the valve box 11 by a console rear panel 16 of the seat console 13 of the operator's cabin 4 and the rear side walls of the tanks 20, 21. The fluid tanks 20, 21 filled with fluid, i.e. in the present case fuel or hydraulic oil, possess a highly noise-dampening effect, in particular when they are made from plastic and are filled with fluid. For the further noise insulation of the operator's cabin, the console rear panel 16 is covered with insulation material.

Thanks to the disposition of the fluid tanks 20, 21 to absorb engine noise, any noise development in the valve box 11 can also be effectively dampened or insulated. In this way, it is possible to insulate a floor plate 18 of the operator's cabin 4 required for servicing and assembly towards the cabin with relatively little insulation material. The floor plate 18 can thus be formed essentially thinner, whereby the room available in the operator's compartment 14 is larger.

In the longitudinal direction of the mini-excavator, the extension of the fluid tanks 20, 21 towards the front is limited by the dimensions of a tilt cylinder 19 and control apparatuses 12, in particular valves, disposed next to and above same and towards the rear by the dimensions of the engine 8 disposed in the engine compartment 10. The tilt cylinder 19, which effects a limited swivel of a shovel jib 3 through a tilt axis 33, forms together with a rotating motor 35, which moves the superstructure relative to the substructure 1 around a pivot 5, the tank limitation to valve box 11.

Figure 2:
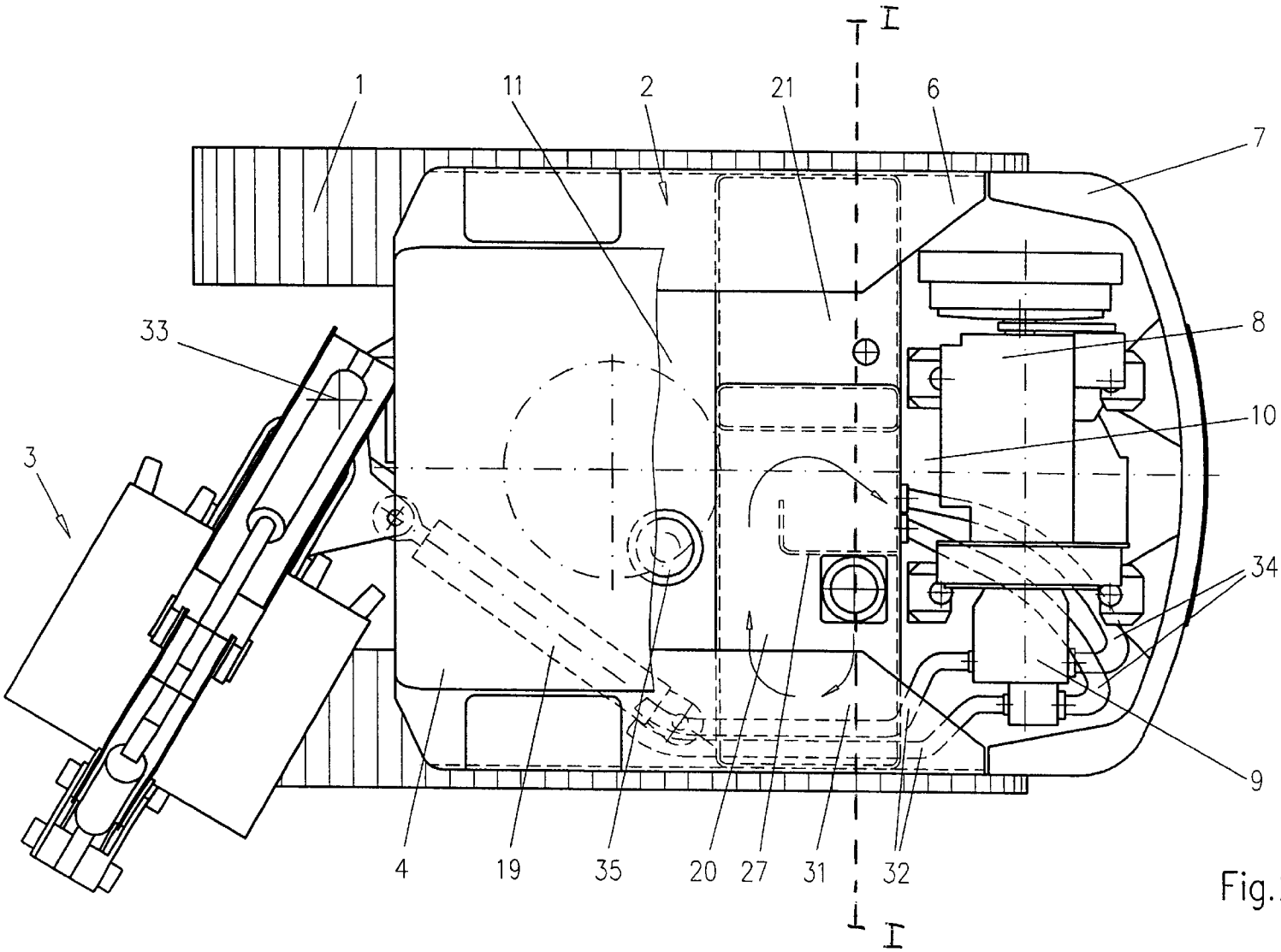
FIG. 2 shows a top view of the mini-excavator from FIG. 1 with a partially removed cabin and without an engine bonnet or seat console.

FIG. 2 shows, as mentioned above, that the fluid tanks 20, 21 extend over the full width of the superstructure 6. Here, the fluid tank 20 abuts with a side wall 40, and the fluid tank 21 with a side wall 41, the inside surface of the superstructure 6, as shown in FIG. 3.

In FIG. 2, there is furthermore shown a hydraulic pump 9 connected to the fluid tank 20 designed as a hydraulic oil tank by means of suction leads 34, which hydraulic pump 9 loads, for example, the tilt cylinder 19 with hydraulic oil by means of pressure lines 32. Pressure lines 32 are here disposed in a line duct 31.

Figure 3:
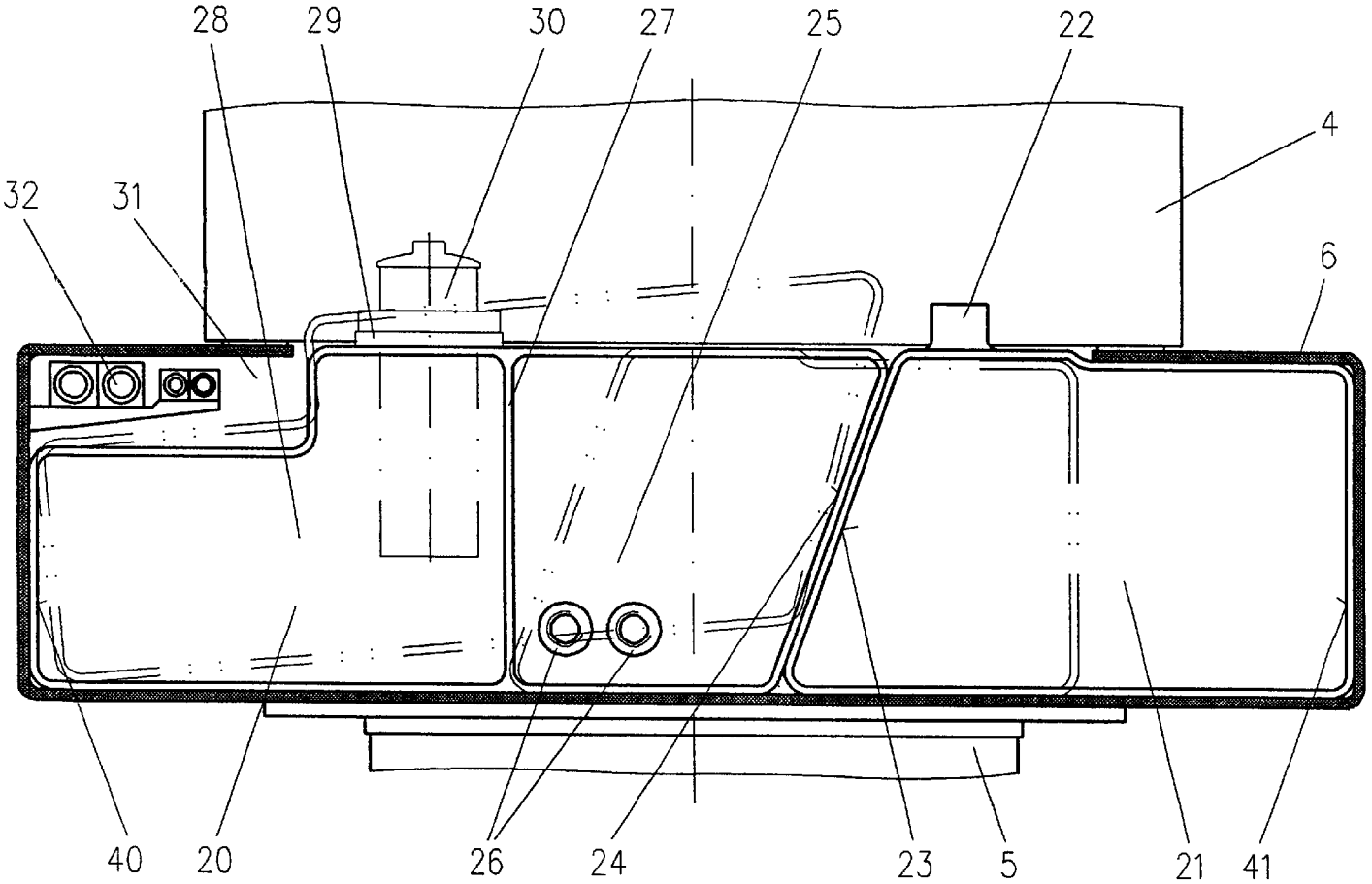
FIG. 3 shows a cross-section view of the fluid tank disposition along the line I—I in FIG. 2, with the installation and removal steps of the fluid tanks being indicated by interrupted lines with dots.

FIG. 3 shows a cross-section through the fluid tanks 20, 21, which are disposed in the superstructure frame 6. Here, continuous lines of the fluid tanks 20, 21 represent the assembly position, while broken and dotted lines serve to illustrate the installation process.

As can be seen from the Figure, the superstructure 6 is formed on its top side with a recess by which the fluid tanks 20, 21 can be inserted. First, the fluid tank designed as the fuel tank 21, which takes up around 30 to 40% of the cross-section area of the superstructure frame 6, is inserted through the recess and pushed so far to the right until its right side wall 41 abuts the inside of the superstructure frame 6. Subsequently, the larger second fluid tank designed as a hydraulic oil tank 20 taking up around 60% of the cross-section area can be inserted through the recess in the superstructure frame 6. To allow an optimum use of room of the total cross-section of the superstructure frame 6, the fuel tank 21 is formed with a positively inclined side wall 23. The hydraulic oil tank 20 possesses a negatively inclined side wall 24 formed in a complementary manner thereto. After the introduction of the fluid tank 21 and its moving to the right up to contact with the inside of the superstructure frame 6, the hydraulic oil tank 20 can be put into its assembly position in the manner indicated by the broken, dotted lines in FIG. 3, while utilizing the two positively or negatively inclined side walls 23, 24, by means of a swivel-in movement through the recess in the superstructure frame 6. By means of the formation of the side walls 23, 24 formed complementarily to each other, it is thus possible to fill up essentially the whole cross-section of the superstructure frame 6 with tank space. The line duct 31, which takes up a small portion of the cross-section of the superstructure frame 6, can, for the event that an intermediate space is left between the lines 32 and the hydraulic oil tank 20, be lined against noise and heat development with insulation material. The removal of the fluid tanks 20, 21 is performed in the opposite order, i.e. first the hydraulic oil tank 20 is removed by means of a swivel-out movement through the recess in the superstructure frame 6 and thereafter the fuel tank 21 can also be removed in a simple manner by a movement to the left into the region of the recess. It should be noted here that the other side walls of the fluid tanks 20, 21 can possess a parallel, inclined or any other appropriate orientation.

Normally, the hydraulic oil tank 20 with its line duct 31 is located on that side of the excavator on which the hydraulic pumps 9 are also disposed. In FIG. 3, by way of example, the hydraulic oil tank 20 is shown with an inflow flange 29 with an integrated oil filter 30. For reasons of space, it may be necessary to use a line filter so that the hydraulic oil can flow into an inflow space 28 of the hydraulic tank 20. Normally, the hydraulic tank 20 is reinforced by a flow guide panel 27 which allows the hydraulic oil to flow in a desired direction to allow the total oil volume to participate in the mixing process. The hydraulic tank is thus divided into an inflow space 28 and a suction space 25, on which suction line connections 26 to the hydraulic pumps 9 are affixed. Inflow space 28 and suction space 25 can be swapped in position if required.

The fuel tank 21 is shown in FIG. 3 by way of example with a filler connection 22 which depending on the space relationships can also be affixed to a side wall of the fuel tank 21.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An excavator, comprising:

a) a substructure and a superstructure pivoted on said substructure with an engine compartment and a valve box of the excavator being formed in said superstructure; and b) first and second fluid tanks together extending essentially over the width of said superstructure and disposed underneath a driver's compartment.

2. An excavator in accordance with claim 1, wherein said superstructure includes an operator's cabin having a driver's seat essentially formed above said at least one fluid tank.

3. An excavator in accordance with claim 1, wherein said engine compartment, said valve box and said and said first and second fluid tanks are disposed at least partially within a frame of said superstructure.

4. An excavator in accordance with claim 2, wherein a heating device is disposed below said driver's seat.

5. An excavator in accordance with claim 1, wherein said first and second fluid tanks are made from one of metal and plastic.

6. An excavator, as in claim 1, wherein said first and second fluid tanks abut one another upon complementary inclined side walls.

7. An excavator, as in claim 6, wherein said inclined side walls run parallel to the longitudinal direction of said superstructure.

8. An excavator, comprising:

a) said excavator including a superstructure pivoted over a substructure;

b) first and second fluid tanks disposed within said superstructure;

c) said first and second fluid tanks abut one another upon complementary inclined side walls to facilitate insertion into or removal from inside of said superstructure; and e) said inclined side walls run parallel to the longitudinal direction of said superstructure.

9. An excavator, comprising:

a) a superstructure pivoted over a substructure, said superstructure including a valve box disposed in front of an engine compartment; and b) first and second fluid tanks disposed between said engine compartment and said valve box, said first and second fluid tanks together extending essentially over the width of said superstructure.

10. An excavator, comprising:

a) a superstructure pivoted over a substructure;

b) first and second fluid tanks extending across the length of a room in said superstructure, said room having an access opening on its top side, said access opening having a length less than said room length; and c) said first and second fluid tanks abut one another upon complementary inclined side walls disposed underneath said access opening to allow insertion or removal of said first and second fluid tanks into or out of said room.

* * * * *